US007175959B2

(12) United States Patent
Fujino et al.

(10) Patent No.: US 7,175,959 B2
(45) Date of Patent: Feb. 13, 2007

(54) TONER AND PRODUCTION PROCESS FOR THE SAME

(75) Inventors: Yasumitsu Fujino, Akishima (JP); Noboru Ueda, Hachioji (JP); Seishi Ojima, Hachioji (JP); Mitsutoshi Nakamura, Hino (JP); Hideaki Ueda, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 260 days.

(21) Appl. No.: 10/788,448

(22) Filed: Mar. 1, 2004

(65) Prior Publication Data

US 2005/0064314 A1 Mar. 24, 2005

(30) Foreign Application Priority Data

Sep. 24, 2003 (JP) ..... 2003-331120

(51) Int. Cl.
*G03G 9/093* (2006.01)

(52) U.S. Cl. ..... 430/108.2

(58) Field of Classification Search ..... 430/110.2
See application file for complete search history.

(56) References Cited

U.S. PATENT DOCUMENTS 5,204,205 A * 4/1993 Anno et al. ..... 430/110.2
5,399,455 A 3/1995 Mikami et al.
5,429,901 A * 7/1995 Muto et al. ..... 430/110.2
6,656,653 B2 12/2003 Mitsuhashi et al.
2001/0033982 A1 10/2001 Ishikawa et al.
2002/0042012 A1 4/2002 Mitsuhashi et al.
2002/0160289 A1* 10/2002 Teshima et al. ..... 430/110.2
2004/0146794 A1 7/2004 Mitsuhashi et al.

FOREIGN PATENT DOCUMENTS

JP 08-059840 A 3/1996
JP 11-7163 1/1999
JP 2000-131882 A 5/2000
JP 2001-201891 A 7/2001
JP 2001-235894 A 8/2001
JP 2002-062686 A 2/2002
JP 2002-82487 3/2002
JP 2003-091093 A 3/2003

* cited by examiner

*Primary Examiner*—Christopher Rodee
(74) *Attorney, Agent, or Firm*—Buchanan Ingersoll & Rooney PC

(57) ABSTRACT

A toner including core particles containing at least a resin and a colorant and coated with a resin coating layer is provided. The core particles are formed by flocculating and fusion-bonding at least resin microparticles and colorant microparticles dispersed in fluid dispersion, while two or more coating layers are formed over the core particles. A wax is added to at least one of the coating layer(s) but for the outermost coating layer, and the core particles. A ratio d/r between an average thickness d of the overall coating layers and a volume average particle size r of the core particles is adjusted to 0.01 to 0.6.

15 Claims, No Drawings

TONER AND PRODUCTION PROCESS FOR THE SAME

RELATED APPLICATION

The present invention is based on Japanese Patent Application No. 2003-331120, the content of which is incorporated by reference.

BACKGROUND OF THE INVENTION

1. Field of the Invention

The present invention relates to a toner and a production process for the same, the toner used for developing an electrostatic image formed on a photosensitive member provided in an image forming apparatus such as copiers and printers. More particularly, the invention relates to a toner which includes core particles containing at least a resin and a colorant and coated with a resin coating layer, and to a process for producing the toner.

2. Description of the Related Art

The image forming apparatuses such as copiers and printers have conventionally used toners for developing an electrostatic image formed on the photosensitive member.

A milling process is widely used for producing such a toner. The process includes the steps of: admixing additives including a colorant, a wax and the like to a resin; melting the mixture by heating and kneading the molten mixture; cooling the kneaded product; and milling the product into toner particles of a predetermined particle size.

Unfortunately, in a case where the toner is produced by the milling process, the produced toner has various problems such as great variations of particle size, poor productivity, and high production costs. In a case where a toner of a small particle size is produced, in particular, a yield is seriously decreased.

More recently, therefore, an emulsion polymerization/flocculation method has been proposed as a toner production method which allows for arbitrary control of the toner particle configuration or of toner particle size distribution.

Where the toner is produced by the aforesaid emulsion polymerization/flocculation method, the following procedure may be taken. A dispersion of resin microparticles is prepared by emulsion polymerization. On the other hand, a dispersion of colorant microparticles is prepared while, as required, a wax dispersion to be used as a wax, or the like, is prepared. These dispersions are blended together and stirred while a suitable flocculating agent such as an inorganic metal salt is added to the dispersion mixture so as to allow the above resin microparticles, colorant microparticles and such to flocculate together. Subsequently, the resultant flocculate is fusion-bonded by heating and thus is produced the toner.

Where the toner is produced in this manner, however, the colorant or the wax used as the wax is exposed to toner surfaces so that the toner is lowered in stability to environment. Hence, the toner is varied in electric charge due to the environmental changes, so that formed images may suffer density variations or fogging. Furthermore, in the case of color image formation, formed images may suffer color tone changes.

More recently, there has been proposed a capsule toner including a core material containing at least a binder resin and a colorant and encapsulated in resin capsules (Japanese Unexamined Patent Publication No. 5-297622).

Unfortunately, however, the capsule toner has the following problem. It is difficult to control the particle size distribution of the toner because the capsule toner is produced by interfacial polymerization of oil-in-water emulsion. As a consequence, the particle size distribution of the capsule toner is too broad.

Furthermore, there has been proposed an alternative toner including at least a binder resin and an encapsulated colorant (Japanese Unexamined Patent Publication No. 11-7163).

However, this toner has a drawback that it is impossible to fully prevent the colorant from being exposed to the surface of toner particles.

There is also proposed a toner wherein resin particles are made to adhere or fix to flocculated particles containing at least primary polymer particles and a colorant, the above primary polymer particles admixed with a wax (Japanese Unexamined Patent Publication No. 2002-82487).

However, the toner has the following problems. In the production of the toner, the primary polymer particles and the colorant particles are flocculated at a temperature lower than a glass transition point Tg of the primary polymer particles and then the resultant flocculate is fusion-bonded. Therefore, when the resin microparticles are made to adhere or fixed to the flocculated particles for forming the toner, the flocculated particles are mixed with the resin microparticles so that it becomes impossible to control the characteristics of the toner which include fixing performance, thermostability/storability, anti-stress performance and the like.

SUMMARY OF THE INVENTION

The invention is directed to a solution to the aforementioned problem encountered by the toner used for developing the electrostatic image formed on the photosensitive member of the image forming apparatuses, such as copiers and printers.

An object of the invention is to suppress the exposure of the colorant, wax and the like to the toner particle surfaces thereby preventing the electric charge of the toner from being varied by the environmental changes or the like.

Another object of the invention is to provide a toner ensuring a consistent formation of favorable images reduced in density variations or less susceptible to fogging.

The toner of the invention includes toner particles comprising:

core particles; formed by flocculating and fusion-bonding at least resin microparticles and colorant microparticles dispersed in fluid dispersion, and coating layer; formed in two or more layers over the core particles.

It is noted here that a wax is added to at least one of the coating layer(s) but for the outermost coating layer and the core particles, and that a ratio d/r between an average thickness d of the overall coating layers and a volume average particle size r of the core particles is in the range of 0.01 to 0.6.

A toner production process according to the invention comprises the steps of:

forming core particles by flocculating and fusion-bonding at least resin microparticles and colorant microparticles; and forming two or more coating layers by flocculating and fusion-bonding the resin microparticles to the surface of the core particles.

It is noted here that the wax is added in at least one of the steps of forming the core particles and of forming the coating layer(s) but for the outermost coating layer and, that a ratio d/r between an average thickness d of the overall coating layers and a volume average particle size r of the core particles is in the range of 0.01 to 0.6.

The toner of the invention can achieve a sharp particle size distribution because the core particles containing at least the resin and the colorant are formed by flocculating and fusion-bonding at least the resin microparticles and the colorant microparticles dispersed in the fluid dispersion, as described above.

According to the toner of the invention, the core particles are coated with two or more resin-oating layers while the ratio d/r between the volume average particle size r of the core particles and the average thickness d of the overall coating layers is adjusted to the range of 0.01 to 0.6. Therefore, the exposure of the colorant and the like to the toner particle surfaces is suppressed so that the electric charge of the toner is prevented from being varied by the environmental changes or the like. As a consequence, the formed images sustain less density variations or fogging.

According to the toner of the invention, the wax is incorporated in at least one of the coating layer(s) but for the outermost coating layer and the core particles, as described above. Therefore, the wax is prevented from being exposed to the surface of the toner particles and hence, the toner is less prone to the degraded thermostability/storability. Furthermore, the wax present in the coating layer(s) but for the outermost coating layer serves to prevent toner offset which may occur at image fixing.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

A toner according to a preferred embodiment of the invention and a production process for the same will be described as below.

The toner according to the embodiment of the invention is produced as follows. First, core particles containing at least a resin and a colorant are formed by flocculating and fusion-bonding at least resin microparticles and colorant microparticles dispersed in fluid dispersion. Two or more resin-coating layers are formed for covering the core particles. A wax is admixed to at least one of the coating layer(s) but for the outermost coating layer and the core particles. A ratio d/r between a volume average particle size r of the above core particles and an average thickness d of the overall coating layers is adjusted to the range of 0.01 to 0.6.

The ratio d/r between the volume average particle size r of the above core particles and the average thickness d of the overall coating layers is adjusted to the range of 0.01 to 0.6 for the following reasons. If the value of the ratio d/r is less than 0.01, it is difficult to fully suppress the exposure of the colorant and the like to the toner particle surfaces. If the value of the ratio d/r is above 0.6, the thickness of the coating layers is so great that the formed image is reduced in density. The value of the above ratio d/r may preferably be in the range of 0.01 to 0.3, or more preferably of 0.01 to 0.1.

If toner particles including the core particles coated with the coating layers have a volume average particle size D50 of 2 to 8 μm, the toner does not encounter a problem that the toner particles are too small to permit the control of the electric charge thereof or to be smoothly transported in development process. Furthermore, the toner particles of the above sizes provide high quality images. The volume average particle size D50 of the toner particles may preferably be in the range of 2 to 5 μm.

The aforementioned toner may be produced by the steps of: forming the core particles by flocculating and fusion-bonding at least resin microparticles and colorant microparticles dispersed in fluid dispersion; and forming two or more coating layers by performing twice or more a step of adding a dispersion of resin microparticles to a dispersion of the core particles thereby flocculating and fusion-bonding the resin microparticles to the surface of the core particles. In addition, a wax is added in at least one of the steps of forming the core particles and the step of forming the coating layer(s) but for the outermost coating layer.

Examples of a usable resin as a constituent of the resin microparticles used for forming the above core particles or coating layer include: radical polymerizable resins such as (meth)acrylate resins and aromatic vinyl resins; condensation polymerizable resins such as polyester resins; and the like. In general, there may be used the resin microparticles having a volume average particle size of 80 to 200 nm. In the light of proper control of the adherence speed of the resin microparticles being flocculated or the thickness of the coating layer formed of the resin microparticles, it is desirable to use the resin microparticles having a volume average particle size of 100 to 150 nm.

The above resin microparticles may be produced by a wet process such as an emulsion polymerization process, a suspension polymerization process and an emulsion dispersion process. It is preferred to produce the resin microparticles by the emulsion polymerization process facilitating the adjustment of the particle size.

The above resin microparticles may be produced by the emulsion polymerization process in the following manner, for example. Droplets of a radical polymerizable monomer solution are formed in a water-based medium containing a surfactant and a radical polymerization initiator. The radical polymerizable monomer in the form of droplets are emulsified and polymerized by the polymerization initiator.

The aforesaid radical polymerizable monomer used for forming the resin microparticles include, for example, aromatic vinyl monomers, (meth)acrylate monomers, vinyl ester monomers, vinyl ether monomers, monoolefin monomers, diolefin monomers, halogenated olefin monomers and the like. From the standpoint of increasing the dispersibility/stability of the resin microparticles, in particular, a radical polymerizable monomer having an acidic group may preferably be used.

Examples of the aforesaid aromatic vinyl monomer include styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene; and the derivatives thereof.

Examples of the aforesaid (meth)acrylate monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl â-hydroxyacrylate, propyl â-aminoacrylate, stearyl methacrylate, dimethylaminoethyl methacrylate, diethylaminoethyl methacrylate and the like.

Examples of the aforesaid vinyl ester monomer include vinyl acetate, vinyl propionate, vinyl benzoate and the like.

Examples of the aforesaid vinyl ether monomer include vinyl methyl ether, vinyl ethyl ether, vinyl isobutyl ether, vinyl phenyl ether and the like.

Examples of the aforesaid monoolefin monomer include ethylene, propylene, isobutylene, 1-butane, 1-pentene, 4-methyl-1-pentene and the like.

Examples of the aforesaid diolefin monomer include butadiene, isoprene, chloroprene and the like.

Examples of the aforesaid halogenated olefin monomer include vinyl chloride, vinylidene chloride, vinyl bromide and the like.

Examples of the aforesaid radical polymerizable monomer having an acidic group include monomers containing a carboxylic group such as acrylic acid, methacrylic acid, fumaric acid, maleic acid, itaconic acid, cinnamic acid, monobutyl maleate and monooctyl maleate; monomers containing a sulfonic group such as styrene sulfonate, allylsulfosuccinate and octyl allylsulfosuccinate; and the like. The all or a part of the radical polymerizable monomer having the acidic group may have a structure of an alkali metal salt such as sodium or potassium or of an alkaline earth metal salt such as calcium.

Where the radical polymerizable monomer and the radical polymerizable monomer having the acidic group are used in combination, the resin microparticles are not sufficiently increased in the dispersibility/stability if the proportion of the radical polymerizable monomer having the acidic group is too small. If, on the other hand, the radical polymerizable monomer having the acidic group is used in an excessive proportion, hygroscopicity associated with the acidic group poses a problem. On this account, the proportion of the radical polymerizable monomer having the acidic group is limited to the range of 0.1 to 20 mass % or preferably of 0.1 to 15 mass %.

For improving the anti-stress performance of the resultant toner, a radically polymerizable crosslinking agent may be added for copolymerization with the aforesaid radical polymerizable monomer.

Examples of the aforesaid radically polymerizable crosslinking agent include compounds having two or more unsaturated bonds, such as divinylbenzene, divinylnaphthalene, divinylether, diethylene glycol methacrylate, ethylene glycol dimethacrylate, polyethylene glycol dimethacrylate, and diallylphthalate.

A chain transfer agent commonly used in the art may be used for adjusting the molecular weight of the above resin. A usable chain transfer agent is not particularly limited herein and may include, for example, mercaptans such as octyl mercaptan, dodecyl mercaptan and tert-dodecyl mercaptan; and styrene dimmers.

The aforesaid radical polymerization initiator used for polymerizing the above radical polymerizable monomers may be soluble in water. Examples of a usable radical polymerization initiator include: persulfates such as potassium persulfate and ammonium persulfate; azo compounds such as 4,4'-azobis(4-cyanovaleric acid) and its salt and a salt of 2,2'-azobis(2-amidinopropane); peroxide compounds; and the like.

The aforesaid radical polymerization initiator may be used in combination with a reducing agent, as required, so as to be used as a redox initiator. The use of the redox initiator is effective to increase polymerization activity so that the polymerization temperature may be lowered. In addition, the polymerization time may be reduced.

A surfactant may be used as an emulsifier for emulsion polymerizing the aforesaid radical polymerizable monomers. Ionic surfactants and nonionic surfactants may be used as such a surfactant.

Examples of a usable ionic surfactant include: sulfonates such as sodium dodecylbenzenesulfonate, sodium arylalkylpolyethersulfonate, sodium 3,3-disulfonediphenylurea-4,4-diazo-bis-amino-8-naphthol-6-sulfonate, ortho-carboxybenzene-azo-dimethylaniline, and sodium 2,2,5,5-tetramethyltriphenylmethane-4,4-diazo-bis-â-naphtol-6-sulfonate; sulfate salts such as sodium dodecylsulfate, sodium tetradecylsulfate, sodium pentadecylsulfate, and sodium octylsulfate; fatty acid salts such as sodium oleate, sodium laurate, sodium caprate, sodium caprylate, sodium caproate, potassium stearate, and calcium oleate; and the like.

Examples of a usable nonionic surfactant include: polyethylene oxide, polypropylene oxide, a combination of polypropylene oxide and polyethylene oxide, an ester of polyethylene glycol and higher fatty acid, alkylphenolpolyethylene oxide, an ester of higher fatty acid and polyethylene glycol, an ester of higher fatty acid and polypropylene oxide, sorbitan ester and the like. The nonionic surfactant may be used in combination with the above ionic surfactant.

In the aforementioned case where the aforesaid nonionic surfactant is used as the emulsifier in the emulsion polymerization process in which the resin microparticles and the colorant microparticles are flocculated together or the resin microparticles are flocculated to the surface of the core particles, the nonionic surfactant may also be used for adjusting the cohesive force of the dispersed microparticles. Specifically, the nonionic surfactant is significantly lowered in the power of dispersing/stabilizing the particles at temperatures higher than its cloud point. Hence, a suitable amount of nonionic surfactant may be previously added in the preparation of the dispersion of the resin microparticles or of the colorant microparticles. When the microparticles are flocculated, the inter-particle cohesive force may be adjusted by controlling the temperature of the dispersion to a suitable level above the aforesaid cloud point of the nonionic surfactant.

The aforesaid colorant microparticles may be prepared by dispersing a colorant in a water-based medium.

The known pigments commonly used in the art may be used as the colorant. Examples of a usable pigment include carbon black, aniline blue, chalcoyl blue, chrome yellow, ultramarine blue, Du Pont Oil Red, quinoline yellow, methylene blue chloride, copper phthalocyanine, malachite green oxalate, lamp black, rose bengal, C.I. pigment red 48:1, C.I. pigment red 122, C.I. pigment red 57:1, C.I. pigment red 184, C.I. pigment yellow 97, C.I. pigment yellow 12, C.I. pigment yellow 17, C.I. solvent yellow 162, C.I. pigment yellow 180, C.I. pigment yellow 185, C.I. pigment blue 15:1, C.I. pigment blue 15:3 and the like.

Where the colorant microparticles are prepared by dispersing the above colorant in the water-based medium, any of the above colorants is added to the water-based medium while the concentration of the surfactant is adjusted to above a critical micelle concentration. A disperser is used for dispersing the above colorant in the water-based medium. The surfactant used here may be the same as that used for preparing the aforesaid resin microparticles. A usable disperser include, for example, pressure dispersers such as ultrasonic dispersers, mechanical homogenizers and pressure-type homogenizers; medium-type dispersers such as sand grinders, diamond fine mills; and the like.

Where the above resin micropparticles and colorant microparticles are flocculated in the fluid dispersion, a salting agent as a flocculating agent is added in an amount to provide a concentration higher than the critical flocculation concentration so as to flocculate the resin microparticles with the colorant microparticles.

As the salting agent, inorganic metal salts such as alkali metal salts and alkaline earth metal salts may be used. Examples of a usable alkali metal include monovalent metals such as lithium, potassium and sodium. Examples of a usable alkaline earth metal include divalent metals such as magnesium, calcium, strontium and barium; and metals having a valence of more than 2, such as aluminum. In general, potassium, sodium, magnesium, calcium, barium and the like may be used. Salts of these metals include chlorine salt, bromine salt, iodine salt, carbonate, sulfate and the like.

In the preparation of the core particles having a predetermined particle size by fusion-bonding the resin microparticles and colorant microparticles thus flocculated, the flocculates may be heated to temperatures of above a glass transition point Tg of the resin microparticles, or preferably to the temperatures of Tg to Tg+40° C. This is because the particles may not be fully fusion-bonded if the heating temperature is lower than the glass transition point Tg of the resin microparticles. If, on the other hand, the heating temperature exceeds Tg+40° C., it is impossible to provide a proper control of the particle size of the resultant core particles.

Where the nonionic surfactant is used as described above, there may be used a nonionic surfactant having a cloud point higher than the glass transition point Tg of the above resin microparticles. For the dual purposes of fully fusion-bonding the particles and properly controlling the size of the resultant core particles, it is preferred to use the nonionic surfactant having a cloud point of Tg to Tg+40° C. The resin microparticles and colorant microparticles may be flocculated and fusion-bonded by heating to a temperature higher than the cloud point of the surfactant.

In the preparation of the above core particles, a charge control agent, magnetic powder, wax and the like may be admixed to the aforementioned resin microparticles and colorant microparticles.

As the charge control agent, any of the known charge control agents used in the prior-art toner for controlling the chargeability thereof may be used. Examples of a usable charge control agent include: metal-containing dyes such as fluorinated surfactants, metal complexes of salicylic acid and azo metal compounds; polymeric acid comprising a copolymer containing maleic acid as a monomer component; azine dyes such as quaternary ammonium salt and nigrosine; carbon black; and the like. In order to attain a favorable electric charge, the charge control agent may be used in an amount of 0.01 to 5 parts by weight or preferably of 0.05 to 3 parts by weight based on the overall weight of the resin including the coating layers.

The aforesaid wax may be any of the known waxes commonly used in the toner. Examples of a usable wax include: polyolefin waxes such as polyethylene wax and polypropylene wax; naturally occurring waxes such as carnauba wax and rice wax; montan wax; Fischer-Tropsh wax; paraffin waxes; and the like. Where the above resin microparticles comprise a polyester resin, it is preferred to use an oxidized wax from the standpoint of improving the dispersibility of the particles.

In order to enhance the fixability/separatability of the particles, the wax may be used in an amount of 0.5 to 12 parts by weight or preferably of 1 to 10 parts by weight based on 100 parts by weight of the overall resin including the coating layers. Where two or more types of waxes are used, a total amount of the waxes is limited to the above range.

The core particles formed in the aforementioned manner may be coated with two or more resin-coating layers by repeating the following step twice or more. That is, a dispersion of the resin microparticles is added to a dispersion of the above core particles so that the resin microparticles are flocculated and fusion-bonded to the core particles thereby to form the coating layer thereover.

The above resin microparticles used for forming the coating layer may be produced the same way as the resin microparticles used for forming the core particles.

In the above formation of the coating layers, a coating layer containing the wax is formed by adding the aforementioned wax in at least one of the steps of forming the coating layers but for the outermost coating layer.

On the other hand, resin microparticles constituting the outermost coating layer may be formed from a resin having a glass transition point Tg of not less than 55° C., or more preferably of not less than 60° C. in order to enhance the thermostability/storability of the toner.

In the aforementioned formation of two or more coating layers, it is preferred that the thickness d of the overall coating layers is adjusted to the range of 0.02 to 2.2 μm provided that the ratio d/r satisfies the aforementioned condition. It is particularly preferred to limit the thickness d of the overall coating layers to the range of 0.02 to 1 μm from the standpoint of enhancing both the thermostability/storability and the anti-separation performance of the toner.

Where the dispersion of the resin microparticles is added to the dispersion of the core particles thereby to flocculate the resin microparticles to the surface of the core particles, as described above, the same procedure as the formation of the core particles is taken. That is, a salting agent as the flocculating agent is added in an amount to provide a concentration higher than the critical flocculation concentration so as to flocculate the resin microparticles to the surface of the core particles.

The salting agent may be the same as that used for forming the core particles. Alternatively, a salting agent which has a higher valence and a greater cohesive force than that used for forming the core particles may be used so as to further increase the speed of flocculating the resin microparticles to the surface of the core particles. As the salting agent of a higher valence, there may be used, for example, a trivalent aluminum salt, tetravalent aluminum polychloride or the like.

Where the resin microparticle dispersion used for forming the above coating layer employs the nonionic surfactant for enhancing the dispersibility/stability of the resin microparticles, the used nonionic surfactant has a cloud point higher than the glass transition point Tg of the resin microparticles, or preferably a cloud point of Tg to Tg+40° C. The reason is that if the surfactant has a cloud point lower than the glass transition point Tg of the resin microparticles, the particles may not be fully fusion-bonded. If, on the other hand, the surfactant has a cloud point higher than Tg+40° C., it becomes impossible to provide a proper control of the size of the resultant particles.

As described above, the resin microparticle dispersion is added to the core-particle dispersion. The resultant dispersion mixture is heated to above the cloud point of the nonionic surfactant for flocculating the resin microparticles to the surface of the core particles as well as for fusion-bonding the resin microparticles to the surface of the core particles.

The toner of the aforementioned embodiment may be admixed with an external additive. As such an external additive, any of the known inorganic microparticles used for adjusting toner fluidity may be used.

Examples of such an inorganic microparticles include: a variety of carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide, diamond carbon lactam; a variety of nitrides such as boron nitride, titanium nitride and zirconium nitride; a variety of borides such as zirconium boride; a variety of oxides such as titanium oxide, calcium oxide, magnesium oxide, zinc oxide, copper oxide, aluminum oxide, silica and colloidal silica; a variety of titanate compounds such as calcium titanate, magnesium titanate and strontium titanate; sulfides such as molybdenum disulfide; a variety of fluorides such as magnesium fluoride and carbon fluoride; a variety of metal soaps such as aluminum stearate, calcium stearate, zinc stearate and magnesium stearate; and a variety of non-magnetic inorganic microparticles such as talc and bentonite. These microparticles may be used alone or in combination of plural types.

It is preferred from the standpoint of controlling the adhesion of the external additive that the aforementioned microparticles of silica, titanium oxide, alumina, zinc oxide or the like may be surface treated with a hydrophobic treating agent conventionally used in the art, such as silane coupling agent, titanate coupling agent, silicone oil or silicone varnish; fluorinated silane coupling agent or fluorinated silicone oil; a coupling agent having an amino group or a quaternary ammonium salt; modified silicone oil; or the like.

The aforesaid inorganic microparticles may have an average primary particle size of 5 to 100 nm, preferably of 10 to 50 nm, or more preferably of 20 to 40 nm. This is because the use of the inorganic microparticles having such a particle size provides for an effective control of the adhesion stress of the toner.

Assume that the amount of inorganic microparticles added to the toner is represented by G (wt %) and that the volume average particle size of the above toner particles is represented by D50 (μm), the value of D50×G may be adjusted to the range of 4 to 14, preferably of 5 to 13.5 or more preferably of 6 to 13 such as to enhance the effect of the toner fluidity and the like.

Besides the aforementioned inorganic microparticles, organic microparticles may be externally added.

Such organic microparticles may be formed from styrene, (meth)acryl, benzoguanamine, melamine, tetrafluoroethylene, silicone, polyethylene, polypropylene or the like by a wet polymerization process such as emulsion polymerization process, soap-free emulsion polymerization process or non-aqueous dispersion polymerization process; a vapor phase process; or the like. The microparticles may be added as a cleaning aid or the like.

The toner according to the above embodiment may be used as a color toner of each color for use in full-color image forming apparatuses and also as a monochromatic toner for use in monochromatic image forming apparatuses.

The toner according to the embodiment provides an adequate transfer performance while retaining good chargeability and stability to environment. Where the toner of the embodiment is used as a color toner of each color in the full-color image forming apparatus, therefore, the formed images are prevented from suffering white spots.

The toner of the invention may be used in image forming apparatuses having any type of fixing device because the toner provides an adequate transfer performance while retaining the good chargeability and stability to environment, as described above. In an image forming apparatus employing a fixing device with a reduced amount of lubricant applied to a fixing member such as a roller or the fixing device with the mold release oil applied thereto in an amount of not more than 4 mg/m$^2$, or in an image forming apparatus employing a fixing device dispensing with the application of the mold release oil, for example, the toner may be used to form images effectively reduced in the white spots.

The toner of the invention may be used as a one-component developer free from carrier and also as a two-component developer comprising a combination of the toner and the carrier.

Next, specific description will be made on toners according to the examples of the invention and the production processes for the same. Furthermore, the superiority of the toners according to the examples of the invention will be demonstrated with reference to comparative examples.

For preparation of toners of Examples 1 to 9 and of Comparative Examples 1 and 2, the following procedures were taken to prepare dispersions of resin microparticles A1 to A4, dispersions of colorant microparticles B1 to B3, and dispersions of waxes C1 and C2.

(Preparation of Wax-C1 Dispersion)

A mixture containing 680 parts by weight of distilled water, 180 parts by weight of carnauba wax (commercially available from CERARICA NODA Co., Ltd.) and 17 parts by weight of sodium dodecylbenzenesulfonate (NEOGEN SC commercially available from DAIICHI-KOGYO CO., LTD.) was emulsified and dispersed by means of a high-pressure shearing machine. Thus was obtained a dispersion of wax C1. The particle size of the dispersed wax C1 was determined by means of Super-dynamic Light Scattering Spectrophotometer (ELS-800 commercially available from OTSUKA ELECTRONICS CO., LTD.). The wax C1 had a volume average particle size of 110 nm.

(Preparation of Wax-C2 Dispersion)

A mixture containing 680 parts by weight of distilled water, 180 parts by weight of wax of pentaerythritol ester (UNISTAR H476 commercially available from NOF CORPORATION) and 17 parts by weight of sodium dodecylbenzenesulfonate (NEOGEN SC commercially available from DAIICHI-KOGYO CO., LTD.) was emulsified and dispersed by means of the high-pressure shearing machine. Thus was obtained a dispersion of wax C2. The particle size of the dispersed wax C2 was determined by means of Super-dynamic Light Scattering Spectrophotometer (ELS-800 commercially available from OTSUKA ELECTRONICS CO., LTD.). The wax C2 had a volume average particle size of 130 nm.

(Preparation of Dispersion of Resin Microparticles A1)

450 parts by weight of distilled water and 0.56 parts by weight of sodium dodecylsulfate were charged to a reaction vessel equipped with a stirrer, a condenser and a temperature sensor. The mixture was heated with stirring to 80° C. under a nitrogen flow and then, was added with 120 parts by weight of aqueous solution of 1 wt % potassium persulfate. Subsequently, a monomer solution mixture containing 117 parts by weight of styrene, 41 parts by weight of butyl acrylate, 14 parts by weight of methacrylic acid and 3 parts by weight of n-octylmercaptan was added dropwise over the course of 1.5 hours. The resultant mixture was maintained in this state for carrying out polymerization over 2 hours and then, was cooled to room temperatures. Thus was obtained a dispersion of resin microparticles A1. The resultant resin microparticles A1 had a weight average molecular weight of 58000, a glass transition point Tg of 52° C., and a softening point Tm of 108° C. Furthermore, the resin microparticles had a volume average particle size of 150 nm as determined by Super-dynamic Light Scattering Spectrophotometer (ELS-800 commercially available from OTSUKA ELECTRONICS CO., LTD.).

The weight average molecular weight was determined by gel permeation chromatography (807-IT model commercially available from NIHON BUNKO KOGYOSYA) as follows. With column temperature maintained at 40° C., tetrahydrofuran as a carrier solvent was flowed through the column under a pressure of 1 kg/cm$^2$. A solution was prepared by dissolving 30 mg of measurement sample in 20 ml of tetrahydrofuran. Then, 0.5 mg of the resultant solution along with the carrier solvent were introduced into the above apparatus to determine the weight average molecular weight based on polystyrene standard.

The glass transition point Tg was determined by a differential scanning calorimeter (DSC-200 commercially available from Seiko Instruments Inc.) as follows. 10 mg of measurement sample was accurately weighed out and charged to an aluminum pan. On the other hand, alumina, as a reference, was charged to an aluminum pan. The sample at normal temperatures was heated to 200° C. at a rate of 30° C./min and then cooled. Measurement was taken in the temperature range of 20 to 120° C. while heating at a rate of 10° C./min. In an endothermic curve in a temperature range of 30 to 90° C. of the heating process, a shoulder of a main endothermic peak was determined as the glass transition point Tg.

The softening point Tm was determined by a flow tester (CFT-500 commercially available from SHIMADZU CORPORATION) as follows. 1.0 g of measurement sample was accurately weighed out and set in a die having a diameter of 1.0 mm and a length of 1.0 mm. The measurement was taken under the conditions: a rate of temperature rise at 30° C./min, a preheating time of 180 seconds, a load of 30 kg and a measurement temperature range of 60 to 180° C. A temperature at which a half of the above sample flowed out of the die was determined as the softening point Tm.

(Preparation of Dispersion of Resin Microparticles A2)

450 parts by weight of distilled water and 0.56 parts by weight of sodium dodecylsulfate were charged to a reaction vessel equipped with a stirrer, a condenser and a temperature sensor. The mixture was heated with stirring to 80° C. under a nitrogen flow and then, was added with 120 parts by weight of aqueous solution of 1 wt % potassium persulfate. Subsequently, a monomer solution mixture containing 125 parts by weight of styrene, 40 parts by weight of butyl acrylate, 2.5 parts by weight of methacrylic acid and 3 parts by weight of n-octylmercaptan was added dropwise over the course of 1.5 hours. The resultant mixture was maintained in this state for carrying out polymerization over 2 hours and then, was cooled to room temperatures. Thus was obtained a dispersion of resin microparticles A2. The resultant resin microparticles A2 had a weight average molecular weight of 62000, a glass transition point Tg of 65° C., and a softening point Tm of 130° C. Furthermore, the resin microparticles had a volume average particle size of 120 nm as determined by Super-dynamic Light Scattering Spectrophotometer (ELS-800 commercially available from OTSUKA ELECTRONICS CO., LTD.).

(Preparation of Dispersion of Resin Microparticles A3)

450 parts by weight of distilled water and 0.56 parts by weight of sodium dodecylsulfate were charged to a reaction vessel equipped with a stirrer, a condenser and a temperature sensor. The mixture was heated with stirring to 80° C. under a nitrogen flow and then, was added with 120 parts by weight of aqueous solution of 1 wt % potassium persulfate. Subsequently, a monomer solution mixture containing 103 parts by weight of styrene, 45 parts by weight of butyl acrylate, 13 parts by weight of methacrylic acid, 5 parts by weight of n-octylmercaptan and 2 parts by weight of charge control agent (Sprion Black TRH commercially available from Hodogaya Chemical Co., Ltd.) was added dropwise over the course of 1.5 hours. The resultant mixture was maintained in this state for carrying out polymerization over 2 hours and then, was cooled to room temperatures. Thus was obtained a dispersion of resin microparticles A3. The resultant resin microparticles A3 had a weight average molecular weight of 24000, a glass transition point Tg of 45° C., and a softening point Tm of 98° C. Furthermore, the resin microparticles had a volume average particle size of 115 nm as determined by Super-dynamic Light Scattering Spectrophotometer (ELS-800 commercially available from OTSUKA ELECTRONICS CO., LTD.).

(Preparation of Dispersion of Resin Microparticles A4)

45 parts by weight of the above wax-C2 dispersion, 450 parts by weight of distilled water and 0.56 parts by weight of sodium dodecylsulfate were charged to a reaction vessel equipped with a stirrer, a condenser and a temperature sensor. The mixture was heated with stirring to 80° C. under a nitrogen flow and then, was added with 120 parts by weight of aqueous solution of 1 wt % potassium persulfate. Subsequently, a monomer solution mixture containing 120 parts by weight of styrene, 38 parts by weight of butyl acrylate, 13 parts by weight of methacrylic acid, 3 parts by weight of n-octylmercaptan and 2 parts by weight of charge control agent (Sprion Black TRH commercially available from Hodogaya Chemical Co., Ltd.) was added dropwise over the course of 1.5 hours. The resultant mixture was maintained in this state for carrying out polymerization over 2 hours and then, was cooled to room temperatures. Thus was obtained a dispersion of resin microparticles A4. The resultant resin microparticles A4 had a weight average molecular weight of 48000, a glass transition point Tg of 55° C., and a softening point Tm of 110° C. Furthermore, the resin microparticles had a volume average particle size of 130 nm as determined by Super-dynamic Light Scattering Spectrophotometer (ELS-800 commercially available from OTSUKA ELECTRONICS CO., LTD.).

(Preparation of Dispersion of Colorant Microparticles B1)

10 parts by weight of sodium dodecylbenzenesulfonate (NEOGEN SC commercially available from DAIICHI-KOGYO CO., LTD.), as an anionic surfactant, was dissolved in 180 parts by weight of distilled water. Then, 25 parts by weight of carbon black (Legal 330R commercially available from Cabot Inc.), as a colorant, was dispersed in the resultant solution to form a dispersion of colorant microparticles B1. The dispersed colorant microparticles B1 had a volume average particle size of 106 nm as determined by Super-dynamic Light Scattering Spectrophotometer (ELS-800 commercially available from OTSUKA ELECTRONICS CO., LTD.).

(Preparation of Dispersion of Colorant Microparticles B2)

10 parts by weight of sodium dodecylbenzenesulfonate (NEOGEN SC commercially available from DAIICHI-KO- GYO CO., LTD.), as an anionic surfactant, was dissolved in 180 parts by weight of distilled water. Then, 25 parts by weight of cyan pigment (copper phthalocyanine B15:3 commercially available from Dainichiseika Color&Chemicals Mfg.Co., Ltd.), as a colorant, was dispersed in the resultant solution to form a dispersion of colorant microparticles B2. The dispersed colorant microparticles B2 had a volume average particle size of 110 nm as determined by Super-dynamic Light Scattering Spectrophotometer (ELS-800 commercially available from OTSUKA ELECTRONICS CO., LTD.).

(Preparation of Dispersion of Colorant Microparticles B3)

10 parts by weight of nonionic surfactant (NAROACTY N-120 commercially available from Sanyo Chemical Industries Ltd.) was dissolved in 180 parts by weight of distilled water. The surfactant had a cloud point of 80° C. Then, 25 parts by weight of cyan pigment (copper phthalocyanine B15:3 commercially available from Dainichiseika Color&Chemicals Mfg. Co., Ltd.), as a colorant, was dispersed in the resultant solution to form a dispersion of colorant microparticles B3. The dispersed colorant microparticles B3 had a volume average particle size of 110 nm as determined by Super-dynamic Light Scattering Spectrophotometer (ELS-800 commercially available from OTSUKA ELECTRONICS CO., LTD.).

EXAMPLE 1

Example 1 used the dispersion of resin microparticles A1 having the glass transition point of 52° C., the dispersion of colorant microparticles B1 and the wax-C1 dispersion for forming core particles.

240 parts by weight of the dispersion of resin microparticles A1, 24 parts by weight of the dispersion of colorant microparticles B1, 13.6 parts by weight of the wax-C1 dispersion, 5 parts by weight of sodium dodecylbenzenesulfate as an anionic surfactant (NEOGEN SC commercially available from DAIICHI-KOGYO CO., LTD.) and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 80° C. and retained in this state for 0.5 hours. Then, the dispersion mixture was heated to 88° C. and retained in this state for 0.5 hours so as to form a dispersion of core particles. The volume average particle size r of the core particles was determined using Coulter multi-sizer II (commercially available from Coulter Electronics Ltd.) and an aperture tube of 50 μm. The core particles had a volume average particle size r of 4.3 μm.

Subsequently, the above core-particle dispersion was cooled to 75° C. and was admixed with 38 parts by weight of the dispersion of resin microparticles A4 having the glass transition point of 55° C. The dispersion mixture was heated to 83° C. and retained in this state for 1.5 hours for fusion-bonding the resin microparticles A4 to the surface of the core particles. Thus was formed a first coating layer.

Next, 20 parts by weight of the dispersion of resin microparticles A2 having the glass transition point of 65° C. was added to the above reaction vessel which was retained for 1 hour. Then, 120 parts by weight of aqueous solution of 20 wt % sodium chloride was added. The resultant mixture was heated to 92° C. and retained in this state for 1 hour so as to fusion-bond the resin microparticles A2 for forming a second layer over the first coating layer overlaid on the core particles. Thus was obtained a dispersion of toner particles.

The dispersion was cooled to room temperatures and then, the toner particles were filtered off. The toner particles were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.4 μm, whereas an average total thickness d of the first and second coating layers was 0.05 μm. That is, a ratio (d/r) of the average thickness d versus the volume average particle size r of the core particles was 0.012.

Then, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having a volume average particle size of 0.2 μm, by means of a Henschel mixer which was operated for 60 seconds at a circumferential speed of 40 m/sec. Thereafter, the resultant mixture was filtered through a 90 μm filter to give a toner of Example 1.

EXAMPLE 2

Example 2 used the dispersion of resin microparticles A2 having the glass transition point Tg of 65° C. in place of the dispersion of resin microparticles A1 having the glass transition point Tg of 52° C., which was used in Example 1. Otherwise, the same procedure as in Example 1 was taken to form core particles having a volume average particle size r of 4.3 μm.

Furthermore, the same procedure as in Example 1 was taken to form toner particles. That is, the resin microparticles A4 were fusion-bonded to the surface of the core particles thereby to form a first coating layer and then, the resin microparticles A2 were fusion-bonded to the first coating layer thereby to overlay a second coating layer thereon.

The toner particles thus formed were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.8 μm, whereas an average total thickness d of the first and second coating layers was 0.25 μm. That is, a ratio (d/r) of the average thickness d versus the volume average particle size r of the core particles was 0.058.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Example 2.

EXAMPLE 3

Example 3 used the wax-C2 dispersion in place of the wax-C1 dispersion used in Example 1. Otherwise, the same procedure as in Example 1 was taken to form core particles having a volume average particle size r of 4.3 μm.

Toner particles were formed the same way as in Example 1. That is, the resin microparticles A4 were fusion-bonded to the surface of the core particles thereby to form a first coating layer and then, the resin microparticles A2 were fusion-bonded to the first coating layer thereby to overlay a second coating layer thereon.

The toner particles thus formed were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.6 μm, whereas an average total thickness d of the first and second coating layers was 0.15 μm. That is, a ratio (d/r) of the average thickness d versus the volume average particle size r of the core particles was 0.035.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Example 3.

EXAMPLE 4

Likewise to Example 1, Example 4 used the dispersion of resin microparticles A1 having the glass transition point of 52° C., the dispersion of colorant microparticles B1 and the wax-C1 dispersion for forming core particles.

240 parts by weight of the dispersion of resin microparticles A1, 24 parts by weight of the dispersion of colorant microparticles B1, 13.6 parts by weight of the wax-C1 dispersion and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 70° C. and retained in this state for 1.5 hours so as to form a dispersion of core particles. The core particles had a volume average particle size r of 4.1 μm.

Subsequently, the above core-particle dispersion was admixed with 38 parts by weight of the dispersion of resin microparticles A4 having the glass transition point of 55° C. and 20 parts by weight of aqueous solution of 50 wt % magnesium chloride, and retained in this state for 1.5 hours for fusion-bonding the resin microparticles A4 to the surface of the core particles. Thus was formed a first coating layer.

Next, the above dispersion was heated to 83° C. and then was admixed with 20 parts by weight of the dispersion of resin microparticles A2 having the glass transition point Tg of 65° C. The dispersion mixture was retained in this state for 1 hour. Subsequently, the dispersion mixture was further admixed with 120 parts by weight of aqueous solution of 20 wt % sodium chloride and heated to 92° C. The dispersion mixture was retained in this state for 1 hour so as to fusion-bond the resin microparticles A2 for forming a second layer over the first layer overlaid on the core particles. Thus was obtained a dispersion of toner particles.

The resultant dispersion was cooled to room temperatures and then, the toner particles were filtered off. The toner particles were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.3 μm, whereas an average total thickness d of the first and second coating layers was 0.10 μm. That is, a ratio (d/r) of the average thickness d versus the volume average particle size r of the core particles was 0.024.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Example 4.

EXAMPLE 5

Example 5 used the dispersion of resin microparticles A2 having the glass transition point Tg of 65° C. in place of the dispersion of resin microparticles A1 having the glass transition point Tg of 52° C., which was used in Example 4. Otherwise, the same procedure as in Example 1 was taken to form core particles having a volume average particle size r of 4.1 μm.

Toner particles were formed the same way as in Example 4. That is, the resin microparticles A4 were fusion-bonded to the surface of the core particles to form a first coating layer and then, the resin microparticles A2 were fusion-bonded so as to form a second coating layer over the first coating layer.

The toner particles thus formed were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.9 μm, whereas an average total thickness d of the first and second coating layers was 0.40 μm. That is, a ratio (d/r) of the average thickness d versus the volume average particle size r of the core particles was 0.098.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Example 5.

EXAMPLE 6

Example 6 used the dispersion of resin microparticles A1 having the glass transition point Tg of 52° C., the dispersion of colorant microparticles B3 and the wax-C1 dispersion for forming core particles.

240 parts by weight of the dispersion of resin microparticles A1, 24 parts by weight of the dispersion of colorant microparticles B3, 13.6 parts by weight of the wax-C1 dispersion, 5 parts by weight of nonionic surfactant (NAROACTY N-160 commercially available from Sanyo Chemical Industries Ltd.) having the cloud point of 80° C. and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 82° C. and retained in this state for 0.5 hours. The dispersion mixture was further heated to 88° C. and retained for 0.5 hours so as to form a dispersion of core particles. The core particles had a volume average particle size r of 4.3 μm.

After cooled to 75° C., the above core-particle dispersion was admixed with 38 parts by weight of the dispersion of resin microparticles A4 having the glass transition point Tg of 55° C. and 20 parts by weight of aqueous solution of 50 wt % magnesium chloride. The resultant dispersion mixture was heated to 82° C. and retained in this state for 1.5 hours for fusion-bonding the resin microparticles A4 to the surface of the core particles. Thus was formed a first coating layer.

Next, the above dispersion was admixed with 20 parts by weight of the dispersion of resin microparticles A2 having the glass transition point Tg of 65° C. and was retained in this state for 1 hour. Subsequently, the dispersion mixture was further admixed with 120 parts by weight of aqueous solution of 20 wt % sodium chloride and heated to 92° C. The dispersion mixture was retained in this state for 1 hour so as to fusion-bond the resin microparticles A2 for forming a second layer over the first coating layer overlaid on the surface of the core particles. Thus was obtained a dispersion of toner particles.

The resultant dispersion was cooled to room temperatures and then, the toner particles were filtered off. The toner particles were washed with distilled water and filtered several times and then dried. A filtrate left after the above cleaning/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.4 μm, whereas an average total thickness d of the first and second coating layers was 0.05 μm. That is, a ratio (d/r) of the average thickness d versus the volume average particle size r of the core particles was 0.012.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Example 6.

EXAMPLE 7

Example 7 used the wax-C2 dispersion in place of the wax-C1 dispersion, which was used in Example 6. Otherwise, the same procedure as in Example 1 was taken to form core particles having a volume average particle size r of 4.3 μm.

Toner particles were formed the same was as in Example 6. That is, the resin microparticles A4 were fusion-bonded to the surface of the core particles to form a first coating layer and then, the resin microparticles A2 were fusion-bonded to the first coating layer to form a second coating layer thereover.

The toner particles thus formed were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.8 μm, whereas an average total thickness d of the first and second coating layers was 0.25 μm. That is, a ratio (d/r) of the average thickness d versus the volume average particle size r of the core particles was 0.058.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90μm filter to give a toner of Example 7.

EXAMPLE 8

Example 8 used the dispersion of resin microparticles A1 having the glass transition point Tg of 52° C., the dispersion of colorant microparticles B3 and the wax-C1 dispersion for forming core particles.

240 parts by weight of the dispersion of resin microparticles A1, 24 parts by weight of the dispersion of colorant microparticles B3, 13.6 parts by weight of the wax-C1 dispersion, 5 parts by weight of nonionic surfactant (NAROACTY N-120 commercially available from Sanyo Chemical Industries Ltd.) having the cloud point of 80° C., and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 80° C. and retained in this state for 0.5 hours. The dispersion mixture was further heated to 88° C. and retained for 0.5 hours so as to form a dispersion of core particles. The core particles had a volume average particle size r of 4.3 μm.

After cooled to 75° C., the above core-particle dispersion was admixed with 28 parts by weight of the dispersion of resin microparticles A3 having the glass transition point of 45° C. The resultant dispersion mixture was heated to 83° C. and retained in this state for 0.5 hours for fusion-bonding the resin microparticles A3 to the surface of the core particles. Thus was formed a first coating layer.

After cooled to 75° C., the above dispersion was admixed with 38 parts by weight of the dispersion of resin microparticles A4 having the glass transition point Tg of 55° C. The dispersion mixture was heated to 82° C. and retained in this state for 1.5 hours so as to fusion-bond the resin microparticles A4 for forming a second coating layer over the first coating layer overlaid on the surface of the core particles.

Subsequently, the above dispersion was admixed with 20 parts by weight of the dispersion of resin microparticles A2 having the glass transition point Tg of 65° C. and retained in this state for 1 hour. Then, the dispersion was admixed with 120 parts by weight of aqueous solution of 20 wt % sodium chloride, heated to 92° C. and retained for 1 hour so as to fusion-bond the resin microparticles A2 to the second coating layer. Thus was formed a dispersion of toner particles with a third coating layer overlaid on the second coating layer.

The resultant dispersion was cooled to room temperatures and then, the toner particles were filtered off. The toner particles were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.6 μm, whereas an average total thickness d of the first to third coating layers was 0.15 μm. That is, a ratio (d/r) of the average thickness d versus the volume average particle size r of the core particles was 0.035.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Example 8.

EXAMPLE 9

Example 9 used the wax-C2 dispersion in place of the wax-C1 dispersion, which was used in Example 8. Otherwise, the same procedure as in Example 1 was taken to form core particles having a volume average particle size r of 4.3 μm.

Toner particles were formed the same way as in Example 8. That is, the resin microparticles A3 were fusion-bonded to the surface of the core particles to form a first coating layer and then, the resin microparticles A4 were fusion-bonded to the first coating layer to form a second coating layer thereover. Furthermore, the resin microparticles A2 were fusion-bonded to the second coating layer to form a third coating layer.

The toner particles thus formed were washed with distilled water and filtered several times and then dried. A filtrate left after the above washing/filtering steps was transparent and colorless and hence, it was confirmed that the above colorant was incorporated in the toner particles. As observed with SEM, the dried toner particles had smooth surface free from the exposure of the colorant. The toner particles had a volume average particle size D50 of 4.8 μm, whereas an average total thickness d of the first to third coating layers was 0.25 μm. That is, a ratio (d/r) of the average thickness d versus the volume average particle size r of the core particles was 0.058.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Example 9.

COMPARATIVE EXAMPLE 1

Comparative Example 1 used the dispersion of resin microparticles A1 having the glass transition point Tg of 52° C., the dispersion of colorant microparticles B1 and the wax-C1 dispersion for forming core particles.

288 parts by weight of the dispersion of resin microparticles A1, 24 parts by weight of the dispersion of colorant microparticles B1, 13.6 parts by weight of the wax-C1 dispersion and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 70° C. and retained in this state for 1.5 hours. The dispersion mixture was admixed with 120 parts by weight of aqueous solution of 20 wt % sodium chloride, heated to 92° C. and retained for 1 hour so as to fusion-bond the flocculated particles as well as to increase the roundness thereof. Thus was obtained a dispersion of toner particles consisting of core particles free from the coating layer.

The dispersion was cooled to room temperatures and the toner particles were filtered off. The toner particles were washed with distilled water and filtered several times and then dried. A filtrate left after the above washing/filtering steps was slightly colored, thus showing that the above colorant was not fully incorporated in the toner particles. As observed with SEM, the dried toner particles suffered the exposure of some of the colorant. The toner particles had a volume average particle size D50 of 4.7 μm.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Comparative Example 1.

COMPARATIVE EXAMPLE 2

Comparative Example 2 used the dispersion of resin microparticles A1 having the glass transition point Tg of 52° C., the dispersion of colorant microparticles B2 and the wax-C1 dispersion for forming core particles.

30 parts by weight of the dispersion of resin microparticles A1, 24 parts by weight of the dispersion of colorant microparticles B2, 13.6 parts by weight of the wax-C1 dispersion, and 240 parts by weight of distilled water were charged to a reaction vessel equipped with a stirrer, a condenser and a temperature sensor. Then, an aqueous 2N sodium hydroxide was added with stirring to adjust the pH of the dispersion mixture to 10.0. The dispersion mixture was admixed with 40 parts by weight of aqueous solution of 50 wt % magnesium chloride. The dispersion mixture was heated with stirring to 70° C. and retained in this state for 1.5 hours so as to form a dispersion of core particles. The core particles had a volume average particle size r of 2.1 μm.

Next, the above core-particle dispersion was admixed with 330 parts by weight of the dispersion of resin microparticles A2 having the glass transition point Tg of 65° C., heated to 83° C. and retained in this state for 0.5 hours. Then, 120 parts by weight of aqueous solution of 20 wt % sodium chloride was further added. The resultant dispersion mixture was heated to 92° C. and retained in this state for 1 hour so as to fusion-bond the resin microparticles A2 to the surface of the core particles. Thus was obtained a dispersion of toner particles formed with a first coating layer.

The toner particle dispersion was cooled to room temperatures and the toner particles were filtered off. The toner particles were washed with distilled water and filtered several times and then dried. The toner particles had a volume average particle size D50 of 4.8 μm, whereas an average thickness d of the first coating layer was 1.35 μm. That is, a ratio (d/r) of the average thickness d versus the volume average particle size r of the core particles was 0.64.

Subsequently, the same procedure as in Example 1 was taken. That is, 100 parts by weight of the above toner particles were blended with 0.5 parts by weight of hydrophobic silica (H-2000 commercially available from Clariant Inc.), 1.0 part by weight of titanium oxide (STT30A commercially available from Titan Kogyo Kabushiki Kaisha) and 1.0 part by weight of strontium titanate having the volume average particle size of 0.2 μm, by means of the Henschel mixer which was operated for 60 seconds at a circumferential speed of 40 m/sec. Thereafter, the resultant mixture was filtered through a 90 μm filter to give a toner of Comparative Example 2.

The toners of Examples 1 to 9 and of Comparative examples 1, 2 produced in the aforementioned manners were evaluated for thermostability. The results are listed in Table 1A and Table 1B as below. The toners were examined as follows. A 10 g sample of each of the toners was allowed to stand under a high temperature of 50° C. for 24 hours and thereafter, visually observed. The thermostability of the individual toners was evaluated based on the following criteria: ○ represents a toner absolutely free from toner aggregation; Δ represents a toner containing less than 10 aggregated pieces; and X represents a toner containing more than 10 aggregated pieces.

The above toners of Examples 1 to 9 and Comparative Examples 1, 2 were also evaluated for anti-separation and anti-offset performances. The results are listed in Table 1A and Table 1B as below.

For examination of the anti-separation and anti-offset performances, each of the toners was mixed with a carrier to form each developer having a toner density of 6 wt %.

The following carrier was used. That is, 100 parts by weight of polyester resin (NE-1110 commercially available from Kao Corp.), 700 parts by weight of magnetic particles (Magnetite EPT-1000 commercially available from TODA KOGYO CORP.) and 2 parts by weight of carbon black (Mogal L commercially available from Cabot Inc.) were fully blended together by a Henschel mixer. The resultant mixture was melt kneaded by means of a twin-screw extruder/kneader having the temperature of its cylinder portion set to 180° C. and that of its cylinder head set to 170° C. After cooling, the kneaded product was roughly ground by a hammer mill and then finely pulverized by a jet pulverizer. The resultant particles were classified to give a binder-type carrier having a volume average particle size of 40 μm.

The anti-separation performance was examined as follows. Each of the above developers was used in a digital copier provided with an oil-less fixing device (DIALTA Di350 commercially available from Minolta Co., Ltd.). The copier was operated to fix to a recording paper sheet a 1.5 cm×1.5 cm solid image having a toner adhesion of 2.0 mg/cm$^2$. The fixing temperature was varied from 120° C. to 170° C. in steps of 2° C. The recording sheet was folded along the center of the image portion to evaluate the image separation by visual observation. The lowest fixing temperature was defined by a temperature intermediate a fixing temperature associated with a minor image separation and the lowest possible temperature to provide image fixation absolutely free from separation. The anti-separation performance was evaluated based on the criteria: ◎ represents a toner achieving a lowest fixing temperature of less than 142° C.; ○ represents a toner achieving a lowest fixing temperature of 142° C. or more and less than 146° C.; Δ represents a practically acceptable toner achieving a lowest fixing temperature of 146° C. or more and less than 152° C.; and X represents a practically unacceptable toner having a lowest fixing temperature of 152° C. or more.

The anti-offset performance was examined as follows. Each of the above developers was used in the aforesaid digital copier (DIALTA Di350 commercially available from Minolta Co., Ltd.) for producing a copy of a halftone image. The speed of a fixing system of the copier was set to ½ of the normal speed whereas the fixing temperature was varied from 130° C. to 190° C. in steps of 2° C. The resultant copies were examined for offset by visual observation so as to determine a temperature associated with offset occurrence. The anti-offset performance was evaluated based on the criteria: ◎ represents a toner having an offset occurrence temperature of 168° C. or more; ○ represents a toner having an offset occurrence temperature of 160° C. or more and less than 168° C.; Δ represents a practically acceptable toner having an offset occurrence temperature of 155° C. or more and less than 160° C.; and X represents a practically unacceptable toner having an offset occurrence temperature of less than 155° C.

The above toners of Examples 1 to 9 and of Comparative Examples 1, 2 were also examined for the stability to environment. The results are listed in Table 1A and Table 1B as below.

The stability to environment was examined as follows. A 30 g sample of each developer was allowed to stand under low-temperature, low-humidity environment (10° C., 15%) for 24 hours, whereas a 30 g sample of each developer was allowed to stand under high-temperature, high-humidity environment (30° C., 85%). Each developer sample was charged to a 50 cc polyethylene vessel and was agitated by a ball mill which was operated at 120 rpm for 5 minutes. Thereafter, the electric charge of each toner was determined by a blow-off method. There was determined a difference between the electric charges of the toners allowed to stand under the low-temperature, low-humidity environment and under the high-temperature, high-humidity environment. The stability to environment was evaluated based on the criteria: ⊙ represents a toner having an absolute difference value of less than 6 μμC/g; ○ represents a toner having an absolute difference value of 6 μC/g or more and less than 7 μC/g; Δ represents a toner having an absolute difference value of 7 μC/g or more and less than 8 μC/g; X represents a toner having an absolute difference value of 8 μC/g or more and less than 9 μC/g; and X X represents a toner having an absolute difference value of 9 μC/g or more.

The above toners of Examples 1 to 9 and of Comparative Examples 1, 2 were also examined for the anti-stress performance. The results are listed in Table 1A and Table 1B as below. The anti-stress performance was examined as follows. Each of the above developers was used in the digital copier (DIALTA Di350 commercially available from Minolta Co., Ltd.) for continuously printing an image on 100,000 white sheets. Thereafter, the photosensitive member was examined for adhesion of thin film of toner microparticles to the surface thereof. The anti-stress performance was evaluated based on the criteria: ○ represents a toner producing no thin-film adhesion; and X represents a toner producing thin-film adhesion.

TABLE 1A

| | RESIN Tg (° C.) | | | | | | | |
|---|---|---|---|---|---|---|---|---|
| | CORE PARTICLES | FIRST COATING LAYER | SECOND COATING LAYER | THIRD COATING LAYER | r (μm) | D50 (μm) | d (μm) | d/r |
| EXAMPLE 1 | 52 | 55 | 65 | — | 4.3 | 4.4 | 0.05 | 0.012 |
| EXAMPLE 2 | 65 | 55 | 65 | — | 4.3 | 4.8 | 0.25 | 0.058 |
| EXAMPLE 3 | 52 | 55 | 65 | — | 4.3 | 4.6 | 0.15 | 0.035 |
| EXAMPLE 4 | 52 | 55 | 65 | — | 4.1 | 4.3 | 0.10 | 0.024 |
| EXAMPLE 5 | 65 | 55 | 65 | — | 4.1 | 4.9 | 0.40 | 0.098 |
| EXAMPLE 6 | 52 | 55 | 65 | — | 4.3 | 4.4 | 0.05 | 0.012 |
| EXAMPLE 7 | 52 | 55 | 65 | — | 4.3 | 4.8 | 0.25 | 0.058 |
| EXAMPLE 8 | 52 | 45 | 55 | 65 | 4.3 | 4.6 | 0.15 | 0.035 |
| EXAMPLE 9 | 52 | 45 | 55 | 65 | 4.3 | 4.8 | 0.25 | 0.058 |
| COMPARATIVE EXAMPLE 1 | 52 | — | — | — | 4.7 | 4.7 | — | — |
| COMPARATIVE EXAMPLE 2 | 52 | 65 | — | — | 2.1 | 4.8 | 1.35 | 0.64 |

TABLE 1B

| | THERMO-STABILITY | STABILITY TO ENVIRONMENT | ANTI-SEPARATION PERFORMANCE | ANTI-OFFSET PERFORMANCE | ANTI-STRESS PERFORMANCE |
|---|---|---|---|---|---|
| EXAMPLE 1 | ○ | ⊙ | ⊙ | ⊙ | ○ |
| EXAMPLE 2 | ○ | ⊙ | ⊙ | ⊙ | ○ |
| EXAMPLE 3 | ○ | ⊙ | ⊙ | ⊙ | ○ |
| EXAMPLE 4 | ○ | ⊙ | ⊙ | ⊙ | ○ |
| EXAMPLE 5 | ○ | ⊙ | ⊙ | ⊙ | ○ |
| EXAMPLE 6 | ○ | ⊙ | ⊙ | ⊙ | ○ |
| EXAMPLE 7 | ○ | ⊙ | ⊙ | ⊙ | ○ |
| EXAMPLE 8 | ○ | ⊙ | ⊙ | ⊙ | ○ |
| EXAMPLE 9 | ○ | ⊙ | ⊙ | ⊙ | ○ |
| COMPARATIVE EXAMPLE 1 | Δ | XX | X | X | X |
| COMPARATIVE EXAMPLE 2 | ○ | ○ | X | X | ○ |

As apparent from the results, the toner of Comparative Example 1 having no coating layer has poor thermostability, stability to environment and anti-stress performance. The toner of Comparative Example 2 including the core particles formed with a single thick coating layer has poor stability to environment, anti-separation performance and anti-offset performance.

In contrast, all of the toners of Examples 1 to 9 have excellent thermostability, stability to environment, anti-separation performance, anti-offset performance and anti-stress performance.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. A toner including toner particles, each toner particle comprising:

a core particle formed by flocculating and fusion-bonding at least resin microparticles and colorant microparticles dispersed in a fluid dispersion; and two or more coating layers formed over the core particles, wherein at least one of said coating layers except for an outermost coating layer, contains a wax, wherein a ratio d/r between an average thickness d of the overall coating layers and a volume average particle size r of the core particles is in the range of 0.01 to 0.6, and wherein said resin microparticles comprise a resin containing a radical polymerizable monomer having an acidic group as a building block, wherein said radical polymerizable monomer having an acidic group is present in the resin in concentrations of 0.1 to 20 mass %.

2. The toner as claimed in claim 1, wherein a resin constitutes said outermost coating layer and said resin has a glass transition point Tg of 55° C. or more.

3. The toner as claimed in claim 2, wherein the resin constituting said outermost coating layer has a glass transition point Tg of 60° C. or more.

4. The toner as claimed in claim 2 wherein an average thickness d of said overall coating layers is in the range of 0.02 to 2.2 μm.

5. The toner as claimed in claim 4, wherein an average thickness d of said overall coating layers is in the range of 0.02 to 1 μm.

6. The toner as claimed in claim 1, wherein a volume average particle size of said toner particles is in the range of 2 to 8 μm.

7. The toner of claim 6, wherein said ratio d/r is in the range of 0.01 to 0.1.

8. The toner as claimed in claim 1, wherein said ratio dir is in the range of 0.01 to 0.1.

9. The toner as claimed in claim 1, wherein a content of the wax is 0.5 to 12 pars by weight based on 100 parts by weight of the resin contained in the toner particles.

10. The toner as claimed in claim 1 wherein a volume average particle size of said toner particles is in the range of 2 to 5 μm.

11. The toner of claim 1, wherein the radical polymerizable monomer having an acidic group includes a monomer containing a carboxylic group or a sulfonic group, and at least a part of the radical polymerizable monomer having the acidic group optionally has a structure of an alkali metal salt or an alkaline earth metal salt.

12. The toner of claim 1, wherein an average thickness d of said overall coating layers is in the range of 0.02 to 2.2 μm.

13. The toner of claim 12, wherein an average thickness d of said overall coating layers is in the range of 0.02 to 1 μm.

14. The toner of claim 13, wherein said ratio d/r is in the range of 0.01 to 0.3.

15. The toner of claim 1, wherein the core particles and at least one of said coating layers but for the outermost coating layer both contain a wax.

* * * * *